US011913734B2

(12) United States Patent
Yamakoshi et al.

(10) Patent No.: US 11,913,734 B2
(45) Date of Patent: Feb. 27, 2024

(54) CONDENSER WITH INTEGRATED RECEIVER

(71) Applicants: DENSO AIRCOOL CORPORATION, Azumino (JP); DENSO CORPORATION, Kariya (JP)

(72) Inventors: Michihiro Yamakoshi, Azumino (JP); Hiroki Matsuo, Kariya (JP); Masanobu Iio, Kariya (JP)

(73) Assignees: DENSO AIRCOOL CORPORATION, Azumino (JP); DENSO CORPORATION, Kariya (JP)

( * ) Notice: Subject to any disclaimer, the term of this patent is extended or adjusted under 35 U.S.C. 154(b) by 304 days.

(21) Appl. No.: 17/453,085

(22) Filed: Nov. 1, 2021

(65) Prior Publication Data

US 2022/0049908 A1 Feb. 17, 2022

Related U.S. Application Data

(63) Continuation of application No. PCT/JP2021/006960, filed on Feb. 25, 2021.

(30) Foreign Application Priority Data

Mar. 3, 2020 (JP) ..... 2020-036188

(51) Int. Cl.
*F28F 9/02* (2006.01)
*F28F 9/16* (2006.01)
(Continued)

(52) U.S. Cl.
CPC ..... *F28F 9/0243* (2013.01); *F28F 9/0219* (2013.01); *F28F 9/16* (2013.01);
(Continued)

(58) Field of Classification Search
CPC ..... F28F 9/0243; F28F 9/0219; F28F 9/16; F28F 21/084; F28F 2009/029; F28F 2275/04; F28D 2021/0063
(Continued)

(56) References Cited

U.S. PATENT DOCUMENTS 6,374,632 B1 * 4/2002 Nobuta ..... F25B 39/04 62/509
6,622,517 B1 * 9/2003 Whitlow ..... F28F 9/002 62/509
(Continued)

FOREIGN PATENT DOCUMENTS

CN 109425148 A 3/2019
JP 2002350001 A 12/2002
(Continued)

*Primary Examiner* — Claire E Rojohn, III
(74) *Attorney, Agent, or Firm* — Harness, Dickey & Pierce, P.L.C.

(57) ABSTRACT

A receiver includes a large diameter main body portion, and an intermediate member side small diameter portion. A wall thickness of the intermediate member side small diameter portion is smaller than a wall thickness of the main body portion. As a result, heat capacity of the intermediate member side small diameter portion is reduced. As a result, it is possible to complete brazing between the intermediate member side small diameter portion and the intermediate member, at the same time as brazing among tanks, tubes, and fins. A desiccant enclosed in a flexible bag can be taken in and out through the intermediate member side small diameter portion.

10 Claims, 19 Drawing Sheets

(51) Int. Cl.
*F28F 21/08* (2006.01)
*F28D 21/00* (2006.01)

(52) U.S. Cl.
CPC .... *F28F 21/084* (2013.01); *F28D 2021/0063* (2013.01); *F28F 2009/029* (2013.01); *F28F 2275/04* (2013.01)

(58) Field of Classification Search
USPC ..... 165/173
See application file for complete search history.

(56) References Cited

U.S. PATENT DOCUMENTS

2005/0247439 A1* 11/2005 Wada ..... F28D 1/0435 165/132
2006/0123837 A1* 6/2006 Shah ..... F25B 39/04 29/890.07
2011/0198065 A1* 8/2011 Hanafusa ..... F28F 9/0209 165/173
2012/0103007 A1 5/2012 Mitsuhashi et al.
2012/0227946 A1* 9/2012 Kent ..... F25B 43/003 165/173
2013/0206378 A1* 8/2013 Kent ..... F25B 39/04 165/173
2014/0014296 A1* 1/2014 Arino ..... F25B 39/04 165/96
2015/0184908 A1* 7/2015 Suzuki ..... F25B 39/04 165/173
2019/0063802 A1* 2/2019 Numasawa ..... F25B 39/04
2022/0041033 A1* 2/2022 Gutierrez ..... F28D 1/0535

FOREIGN PATENT DOCUMENTS

JP 2002372342 A 12/2002
JP 2012112639 A 6/2012

* cited by examiner

CONDENSER WITH INTEGRATED RECEIVER

CROSS REFERENCE TO RELATED APPLICATION

The present application is a continuation application of International Patent Application No. PCT/JP2021/006960 filed on Feb. 25, 2021, which designated the U.S. and claims the benefit of priority from Japanese Patent Application No. 2020-36188 filed in Japan filed on Mar. 3, 2020, the entire disclosure of the above application is incorporated herein by reference.

TECHNICAL FIELD

This disclosure herein relates to a condenser with an integrated receiver which used in a refrigerant cycle.

BACKGROUND

In a field of air conditioners for vehicle, a refrigerant cycle is used to generate a temperature controlled air. The refrigerant cycle usually loaded with a desiccant to remove moisture mixed in a refrigerant. An amount of desiccant is adjusted for a refrigerant cycle. For example, a refrigerant cycle for passenger automobiles such as a sedan car requires a particular amount of desiccant. In some particular applications, more amount of desiccant is required. In order to load such a desiccant, some passage of the refrigerant cycle needs large diameter for accommodating the desiccant. For example, the desiccant is loaded in a receiver integrally brazed with a condenser. In such a background, a condenser with an integrated receiver have to meet several requirements. In the above aspects, or in other aspects not mentioned, there is a need for further improvements in a condenser with an integrated receiver.

SUMMARY

In the case of adopting the prior art document, if more desiccant is to be arranged, it is necessary to increase a capacity of the receiver for agricultural machinery and construction machinery. Here, since a height of the receiver must be less than or equal to a height of the condenser due to restrictions on mounting on the vehicle, a diameter of the receiver must be increased in order to obtain a large capacity.

Since the desiccant is arranged in the receiver and it is necessary to replace the desiccant, the receiver is usually provided with a removable seal structure. The seal structure usually includes an intermediate member fixed to the receiver and a seal member which is detachably engaged with the intermediate member to close the receiver.

Therefore, as the diameter of the receiver body increases, the diameter of the removable seal structure also increases.

Further, in order to increase the diameter of the receiver, it is necessary to increase the wall thickness of the receiver so as to withstand a high pressure of the refrigerant filled inside. Further, the removable seal structure also has to increase in wall thickness and weight as the diameter increases.

In view of the above background, the following problems occur. As the wall thickness and weight of the seal structure increase, wall thicknesses of a receiver mounting member and a condenser mounting bracket for ensuring a vibration strength of the condenser also increase. As a result, a weight of an entire product including the condenser and the receiver is increased, which leads to an increase in cost.

Further, since the condenser, the receiver, and the intermediate member are usually brazed integrally, if a weight of the receiver body and the intermediate member increases, it is difficult to increase a temperature during brazing. For this reason, there are problems such as an increase in the brazing defect rate and lowering of productivity due to a decrease in a production rate in order rise a temperature.

It is an object of the present disclosure to provide a condenser with an integrated receiver in which a condenser is capable of being brazed integrally in the case using a receiver having such an enlarged diameter.

The present disclosure relates to a condenser with an integrated receiver which includes: a pair of tanks into which a refrigerant flows in and out; a plurality of tubes arranged between the pair of tanks; fins which promote heat exchange between the refrigerant flowing in the tubes and air; and a receiver connected to one of the tanks and is able to take a refrigerant flow from the tank, to store a liquid refrigerant therein, and to supply the liquid refrigerant.

In the disclosure, the receiver has a main body portion having a circular cylindrical shape, and an intermediate member side small diameter portion formed on one side of the main body portion. Then, the intermediate member of the seal structure is arranged in the intermediate member side small diameter portion. The seal member of the seal structure engages with the intermediate member to close the intermediate member side small diameter portion of the receiver. Further, a desiccant enclosed in a flexible bag is provided, and the desiccant is capable of taking in and out of a main body portion of the receiver in a state where the seal member is removed from the intermediate member.

The receiver has a thickness of the intermediate member side small diameter portion which is smaller than a wall thickness of the main body portion. The pair of tanks, the tubes, the fins, the receiver, and the intermediate member are all made of aluminum or an aluminum alloy, and these parts are integrally connected by brazing.

According to the disclosure, at the time of the brazing, the brazing between the tank, the tube, the fins, and the receiver can be completed at the same time as the brazing between the intermediate member side small diameter portion and the intermediate member for the receiver.

In particular, since the wall thickness of the intermediate member side small diameter portion is smaller than the wall thickness of the main body portion, the intermediate member side small diameter portion has a small heat capacity and promoted heat transfer. Therefore, even if a capacity of the receiver as a whole is increased, it is possible to reliably perform brazing between the intermediate member side small diameter portion and the intermediate member. Moreover, since the intermediate member is brazed to the intermediate member side small diameter portion, sufficient pressure resistant property as a container can be maintained even if the wall thickness is reduced in the intermediate member side small diameter portion.

In the disclosure, since the desiccant is sealed in the flexible bag, the desiccant can be taken in and out even from the intermediate member small diameter portion whose diameter is smaller than that of the main body portion at a state in which the seal member is removed.

In the disclosure, a ratio of the wall thickness (t3) of the intermediate member side small diameter portion of the receiver to the wall thickness (t1) of the main body portion is smaller than a ratio of an inner diameter (D3) of the intermediate member side small diameter portion of the receiver to an inner diameter (D1) of the main body portion. In other words, instead of reducing the diameter of the main body portion and the intermediate member side small diameter portion in the same ratio, the wall thickness (t3) of the intermediate member side small diameter portion is made thinner.

As a result, in the disclosure, a heat capacity at the intermediate member side small diameter portion is further reduced, and heat transfer is promoted. Brazing between the receiver and the intermediate member is more reliable.

In the disclosure, the ratio of the inner diameter (D1) of the main body portion of the receiver to the inner diameter (D3) of the intermediate member side small diameter portion is 50% or more and less than 80%. If it is less than 50%, a diameter of the seal structure is too small, and it becomes difficult to take in and out the desiccant. On the contrary, if it is 80% or more, an advantage of improving the heat transfer property due to a diameter reduction becomes insufficient.

In the present disclosure, an inclined portion is formed between the main body portion and the intermediate member side small diameter portion of the receiver. Since the diameter is gradually reduced from the main body portion to the intermediate member side small diameter portion, it is possible to ensure pressure resistant property of the receiver as a container. Moreover, since there is no stepped portion whose diameter suddenly changes, it is possible to improve a taking out property of the desiccant.

In the present disclosure, the intermediate member is a circular cylindrical shape which has both open ends, and has an outer periphery formed with at least one annular groove to hold a brazing material, and is formed with a passage aperture through which the refrigerant flows. Since the annular groove is formed, the brazing material can be reliably held between the intermediate member and the intermediate member side small diameter portion, it is possible to improve the brazing performance.

In the present disclosure, the seal member is a circular cylindrical shape which has one closed end and an outer periphery on the one closed end side formed with at least one O-ring holding groove, and wherein further comprises an O-ring held in the O-ring holding groove. By using the O-ring, it is possible to maintain a sealing performance of the male screw member.

In the present disclosure, the desiccant is enclosed in a flexible bag. The bag has a length in a state deployed at an outside of the receiver is longer than a length of the receiver. Therefore, even if a portion where the desiccant is taken in and out is made smaller by forming the intermediate member side small diameter portion, workability is not impaired.

In the present disclosure, an inflow aperture which allows an inflow of the refrigerant from the condenser is formed in the main body portion of the receiver, and an outflow aperture which allows an outflow of the refrigerant to the condenser is formed in the intermediate member side small diameter portion. Then, an intermediate member communication aperture which communicates with the outflow aperture is formed in the intermediate member, and a seal member communication aperture which communicates with the intermediate member communication aperture is formed in the seal member. Since the refrigerant in the receiver flows out to the condenser via the seal member and the intermediate member, a good refrigerant flow can be ensured even if the intermediate member is arranged in the intermediate member side small diameter portion.

The disclosed aspects in this specification adopt different technical solutions from each other in order to achieve their respective objectives. The objects, features, and advantages disclosed in this specification will become apparent by referring to following detailed descriptions and accompanying drawings.

BRIEF DESCRIPTION OF DRAWINGS

The disclosure is further described with reference to the accompanying drawings in which.

DESCRIPTION OF EMBODIMENT

First Embodiment

Figure 1:
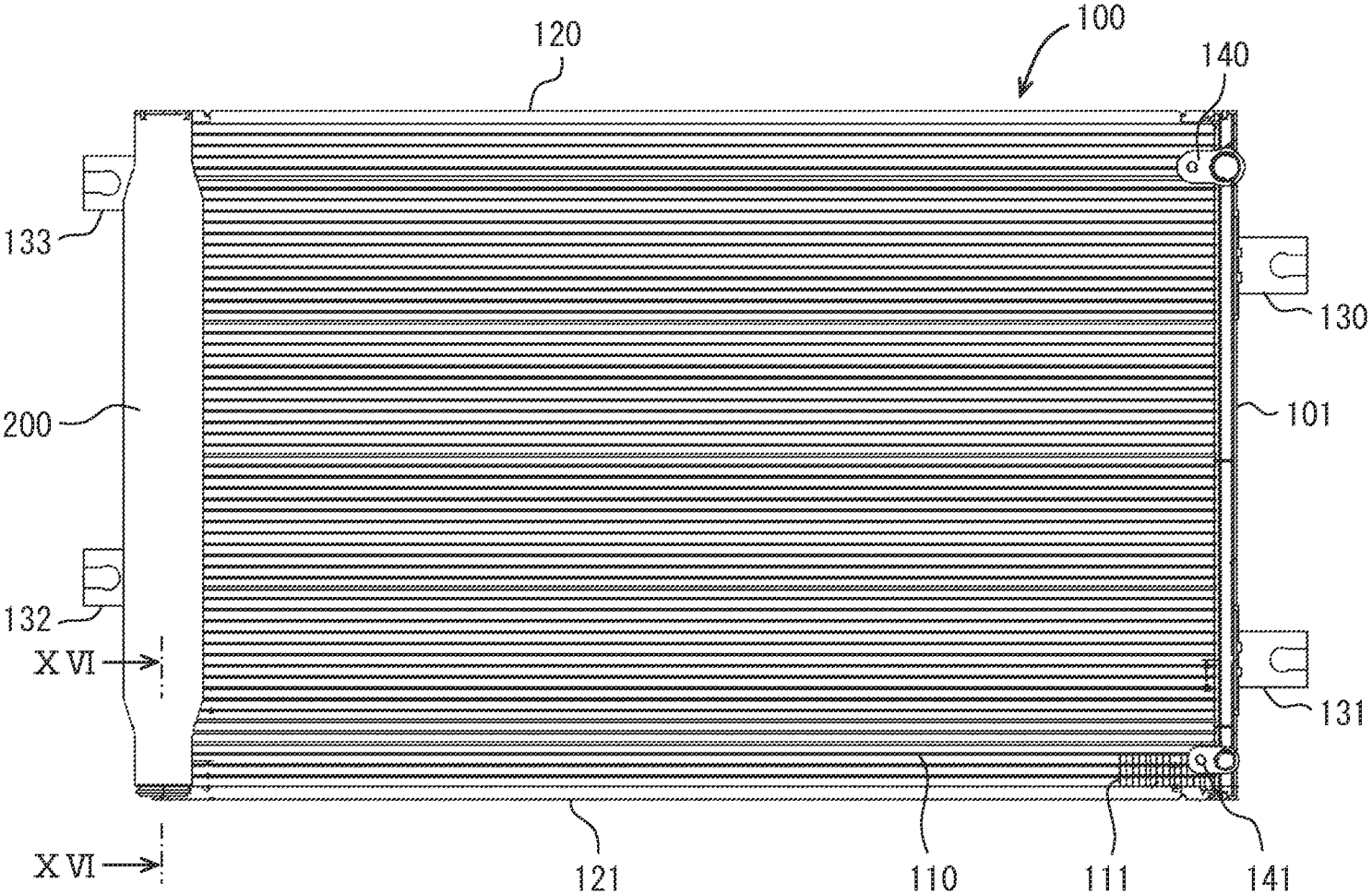
FIG. 1 is a front view of a first embodiment of a condenser with an integrated receiver.

FIG. 1 is a front view of an example of a condenser with an integrated receiver. In the drawings, 100 shows a condenser and 200 shows a receiver. The condenser 100 is larger than a general automobile air conditioner so that it can be used as an air conditioner for agricultural machinery and construction machinery. In this example, a width is about 70 cm and a height is about 40 cm.

Figure 16:
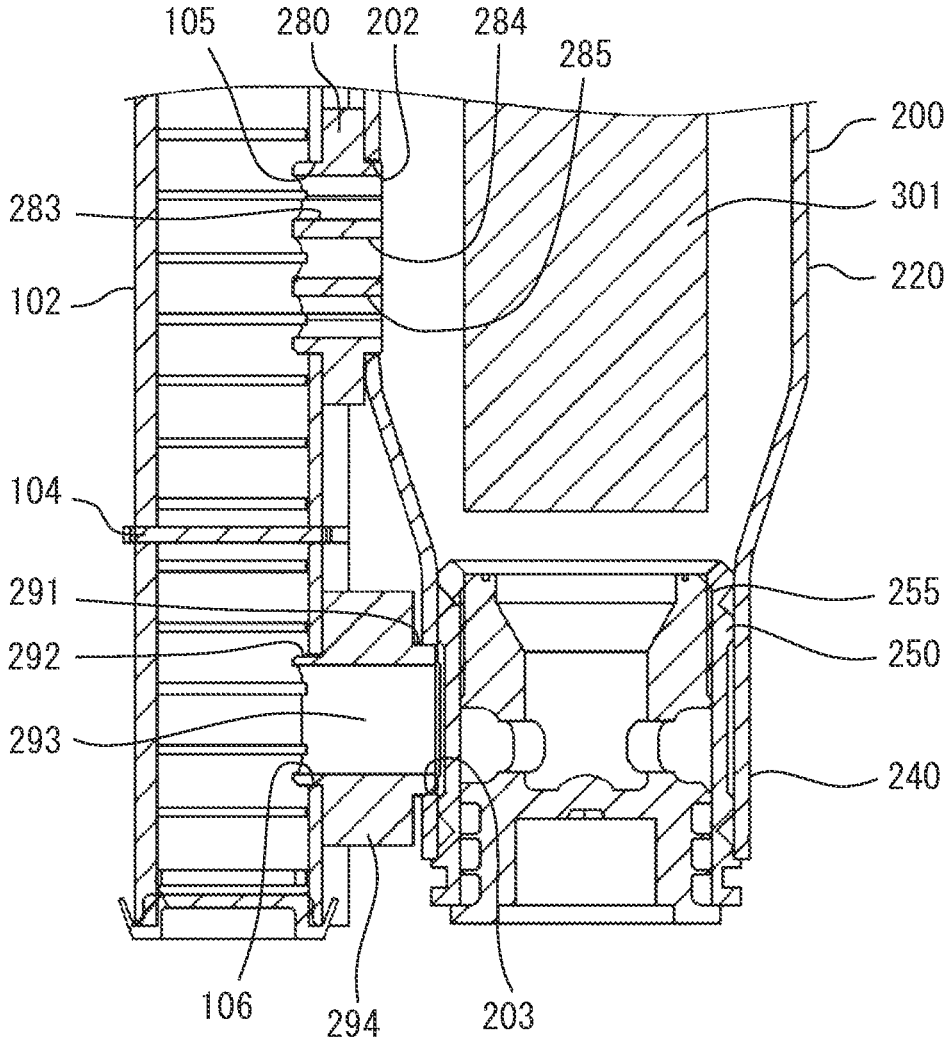
FIG. 16 is a cross-sectional view taken along a line XVI-XVI in FIG. 1 showing mounting state of a seal member.
Figure 18:
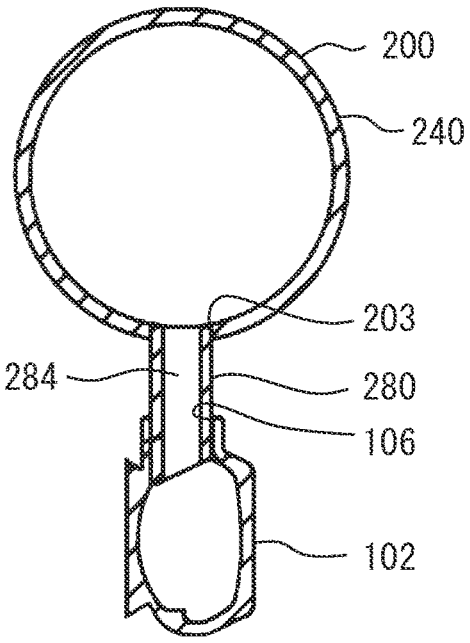
FIG. 18 is a cross-sectional view at a condenser connector position in FIG. 1.
Figure 19:
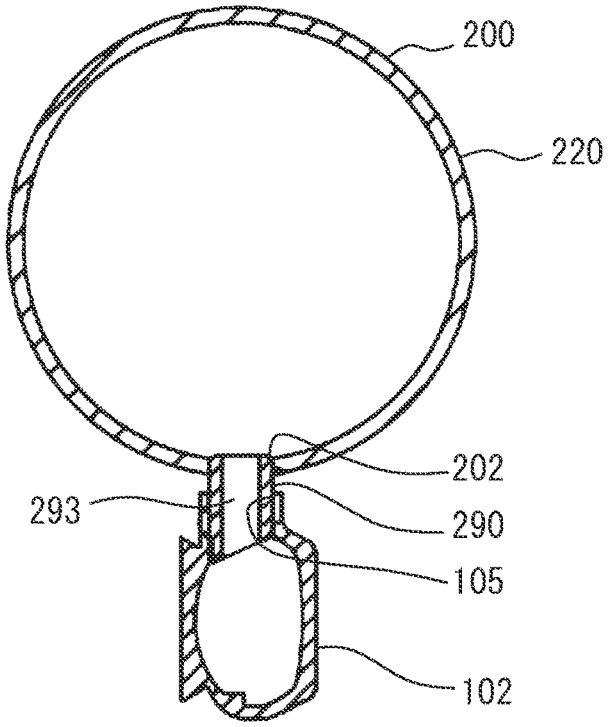
FIG. 19 is a cross-sectional view at a sub-cooler connector position in FIG. 1.
Figure 20:
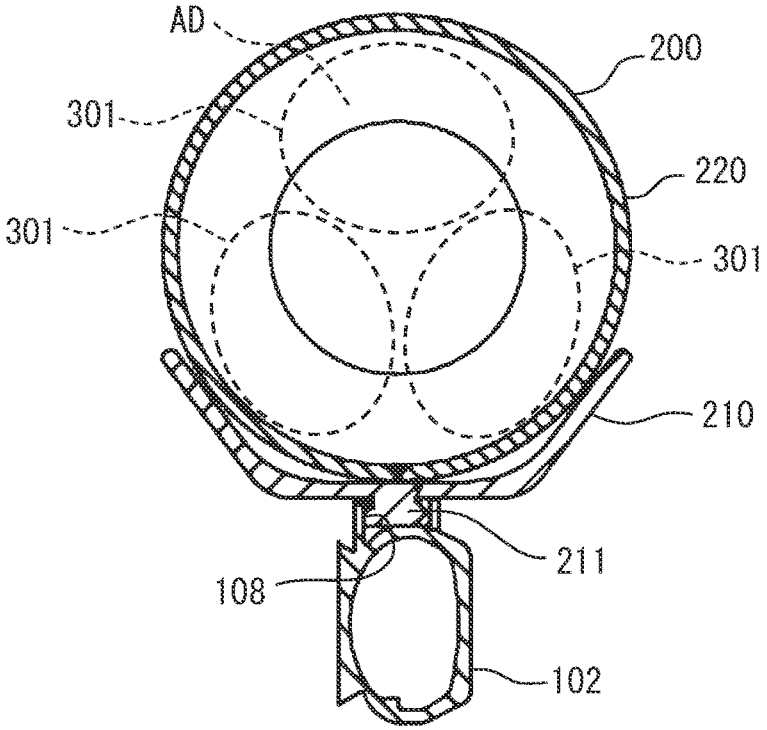
FIG. 20 is a cross-sectional view at a holder plate position in FIG. 1.

The condenser 100 includes a pair of left and right tanks 101 and 102. The left tank 102 is hidden behind the receiver 200 and is shown in FIG. 16. The tanks 101 and 102 have a flat shape as shown in FIGS. 18 to 20. Further, the tanks 101 and 102 are made of aluminum or an aluminum alloy, and both ends thereof are closed by caps.

A plurality of tubes 110 are arranged between the pair of tanks 101 and 102. The tube 110 is made of aluminum or an aluminum alloy, and is an extruded tube having a plurality of refrigerant passage holes inside.

Fins 111 made of aluminum or an aluminum alloy are arranged between the tubes 110. Louvers are cut up and formed on the fin 111 to increase a heat dissipation area of the tube 110. The fins 111 promote heat exchange between a refrigerant flowing inside the tube 110 and an outside air.

An upper reinforcing plate 120 and a lower reinforcing plate 121 are arranged further above and below outermost fins 111, respectively. The upper reinforcing plate 120 and the lower reinforcing plate 121 are also made of aluminum or an aluminum alloy. The upper reinforcing plate 120 and the lower reinforcing plate 121 protect the fins 111 and maintain a strength of the condenser 100.

Reference numerals 130 to 133 show brackets for attaching the condenser to a body housing of agricultural machinery and construction machinery. The condenser 100 is screwed and fixed in a vicinity of an engine of agricultural machinery and construction machinery and at a portion easily exposed to an external wind by using the brackets 130 to 133.

Reference numeral 140 shows an inlet side connector which allows an inflow of a refrigerant from a compressor (not shown.) The compressor is driven by the engine of agricultural machinery or construction machinery, or by a motor.

Two partition plates 104 (shown in FIG. 16) for reversing the refrigerant flow are arranged in the tanks 101 and 102, respectively. The refrigerant flow between the tanks 101 and 102 reciprocates twice by the partition plate 104, and flows out from an outlet side connector 141 toward an expansion valve (not shown) of a refrigeration cycle. The expansion valve is arranged in an operator's room of agricultural machinery or construction machinery together with an evaporator (not shown.)

Figure 2:
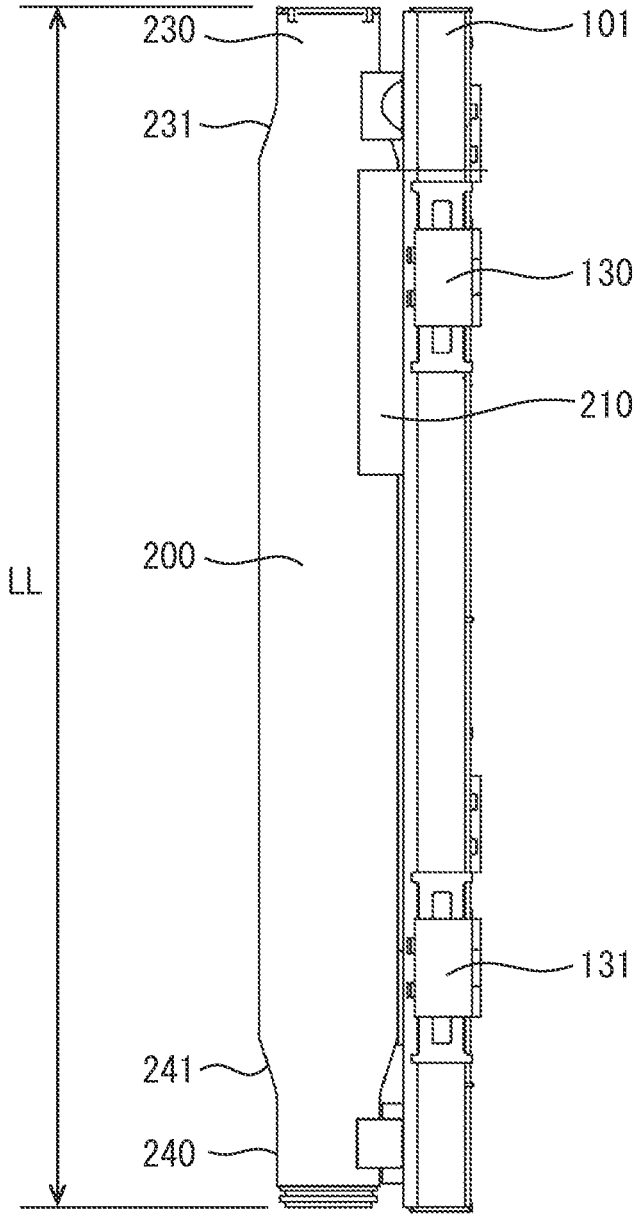
FIG. 2 is a right side view of FIG. 1.

As shown in FIG. 2 and FIG. 20, the receiver 200 is held by the holding plate 210 on the left tank 102. In the held state, the receiver 200 is separated from the condenser 100 by a small distance. The receiver 200 is also made of aluminum or an aluminum alloy, and its height is equal to or shorter than a height of the condenser 100.

Figure 3:
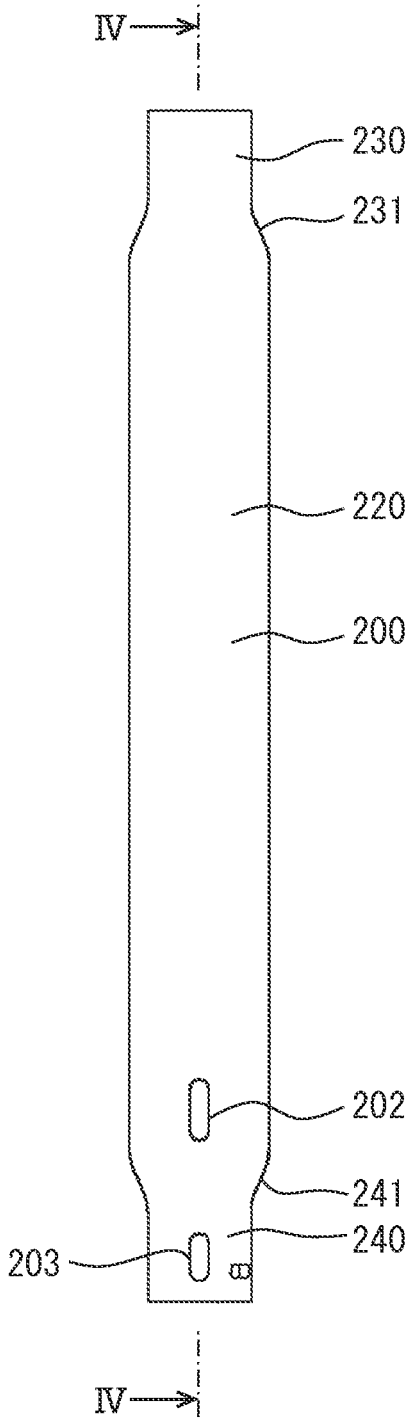
FIG. 3 is a front view of a receiver removed from FIG. 1.
Figure 4:
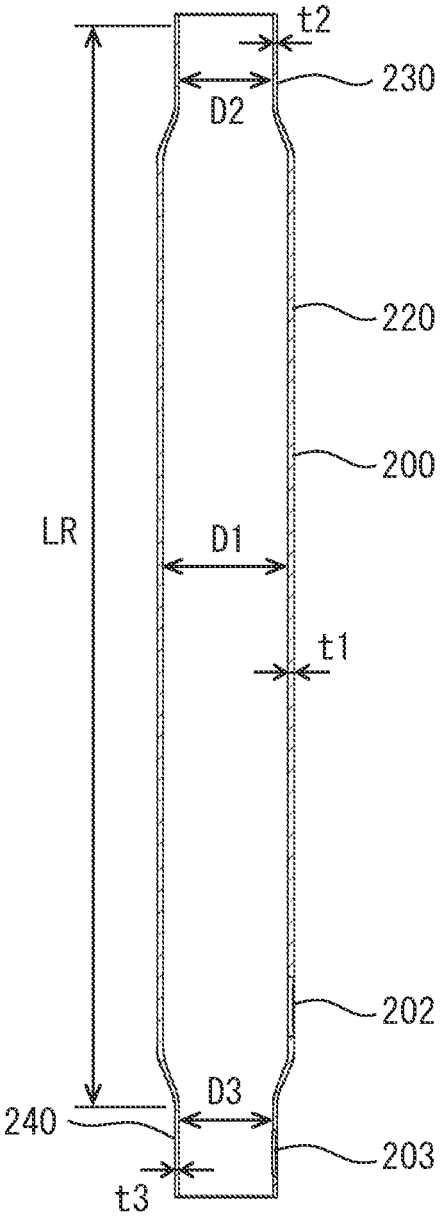
FIG. 4 is a cross-sectional view taken along a line IV-IV in FIG. 3.

As shown in FIG. 3 and FIG. 4, the liquid receiver 200 includes a main body portion 220 having a circular cylindrical shape extending in the vertical direction. The main body portion 220 has an inner diameter (D1) of 41 mm and a wall thickness (t1) of 1.9 mm. The wall thickness required for design is determined by a stress applied and a diameter in the case that a normal refrigerant (CFC R134A) is used.

An upper part of the receiver 200 is closed by a lid member 270 described later. The small diameter portion is about 30 mm, which is a little (about 10%) less than a main portion extending in a vertical direction. This upper small diameter portion is referred to as a lid side small diameter portion 230. An inner diameter (D2) of the lid side small diameter portion 230 is 31 mm, and a wall thickness (t2) is 1.3 mm.

A lower portion of the receiver 200 is an opening through which the desiccant 300 is taken in and out, and is a small diameter portion of about 30 mm, which is a little (about 10%) less than the main portion extending in the vertical direction. The lower part of the receiver 200 is closed by an intermediate member 250 and a seal member 260, which are described later. This lower small diameter portion is referred to as an intermediate member side small diameter portion 240. An inner diameter (D3) of the intermediate member side small diameter portion 240 is 31 mm, and a wall thickness (t3) is 1.3 mm.

Inner diameter ratios (D2/D1) and (D3/D1) of the lid portion side small diameter portion 230 and the intermediate member side small diameter portion 240 are reduced by 76% with respect to the main body portion 220. Plate thickness ratios (t2/t1) and (t3/t1) are reduced (thinned) by 68%. That is, in this example, the diameter of the lid side small diameter portion 230 and the intermediate member side small diameter portion 240 are not simply reduced by the same ratio with respect to the main body portion 220. The diameter of the intermediate member side small diameter portion 240 is reduced so as to be thinner. This is to reduce a heat capacity of the intermediate member side small diameter portion 240, and the details are described later.

The main body portion 220 needs to have a predetermined wall thickness in order to maintain a function as a pressure-resistant container. On the other hand, in the intermediate member side small diameter portion 240, it is possible to reinforce a strength by the intermediate member 250. Similarly, it is possible to reinforce a strength of the lid side small diameter portion 230 by the lid member 270.

In particular, in this example, since the intermediate member 250 described later is arranged in the intermediate member side small diameter portion 240, the wall thickness of the intermediate member 250 can be reduced to 60% as compared with the case where the diameter is not reduced. Since the intermediate member 250 is also a pressure member which holds the refrigerant inside, a predetermined pressure resistant strength is required. If the intermediate member 250 has a diameter to be mounted on the inner diameter (D1) of the main body portion 220, a pressure receiving area also increases, and the intermediate member 250 itself has to be thickened. On the other hand, in the present disclosure, since the diameter of the intermediate member 250 is small, the wall thickness can be reduced.

In particular, in the present disclosure, a female screw 255 is formed on the intermediate member 250 as described later, if a higher pressure resistant strength is required, a height of the female screw 255 must be increased. On the other hand, in the present disclosure, since the diameter is small and the pressure resistant strength can be reduced, the height of the female screw 255 can also be reduced.

Combined with these, in the present disclosure, the wall thickness of the intermediate member 250 can be reduced by 60% as compared with the case where the intermediate member 250 is mounted on the inner diameter (D1) of the main body portion 220.

Between the main body portion 220 and the lid portion side small diameter portion 230, there is a tapered shape 231 in which a diameter is gradually reduced over a length of about 13 mm. Similarly, a tapered shape 241 whose diameter is gradually reduced over a length of about 13 mm is also formed between the main body portion 220 and the intermediate member side small diameter portion 240.

The tapered shapes 231 and 241 suppress sudden changes in the shape of the receiver 200, it is possible to ensure the pressure resistant property as a pressure resistant container. Further, by forming the tapered shape 241 on the intermediate member side small diameter portion 240, it becomes easy to take out a bag 301 of a desiccant 300 described later.

If the tapered shape 241 is not provided, a stepped portion whose diameter suddenly changes is formed in the intermediate member side small diameter portion 240. In that case, when the bag 301 is taken out from the receiver 200, the bag 301 may be caught on the stepped portion. On the other hand, the tapered shape 241 can smoothly guide the bag 301.

Figure 5:
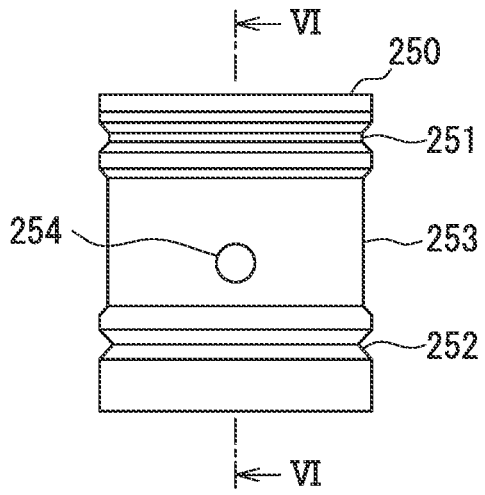
FIG. 5 is a front view of an intermediate member.
Figure 6:
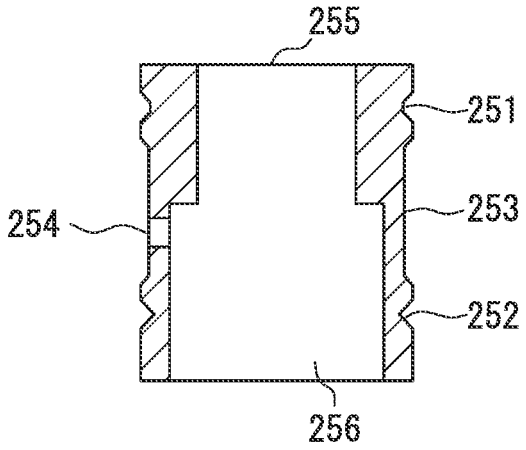
FIG. 6 is a cross-sectional view taken along a line VI-VI in FIG. 5.

As shown in FIG. 5 and FIG. 6, the intermediate member 250 is made of a circular cylindrical member made of aluminum or an aluminum alloy. Two annular grooves 251 and 252 for holding the brazing material are formed on the outer periphery thereof. The portion between the annular groove 251 and the annular groove 252 is a communication space 253 through which the refrigerant flows. An intermediate member communication aperture 254 opens to the communication space 253. The intermediate member communication aperture 254 is also referred to as a female screw communication aperture 254.

A female screw 255 is formed on an inner circumference of the intermediate member 250. The female screw 255 is formed on an upper portion of FIG. 6, and in a state where the intermediate member 250 is inserted into the intermediate member side small diameter portion 240, the female screw 255 is located on a depth side of the receiver 200.

Figure 7:
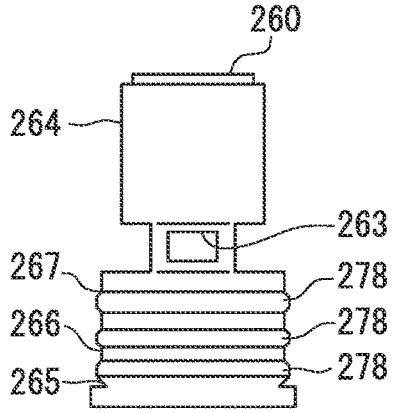
FIG. 7 is a front view of an intermediate member.
Figure 8:
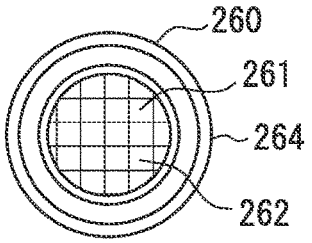
FIG. 8 is an upper surface portion of FIG. 7.

The seal member 260 also has a circular cylindrical shape as shown in FIG. 7 and FIG. 8. The seal member 260 is made of a resin material such as polypropylene, and a refrigerant passage 261 is formed therein. Moreover, a filter 262 is also arranged in the refrigerant passage 261. The refrigerant passage 261 is communicated with an outer circumference via the seal member communication aperture 263, and the seal member communication aperture 263 is communicated with the female screw communication aperture 254 of the intermediate member 250. The seal member communication aperture 263 is also referred to as a male screw communication aperture 263.

A male screw 264 is formed on an outer periphery of the seal member 260, and the male screw 264 is screwed with the female screw 255 of the intermediate member 250. Three O-ring holding grooves 265, 266, and 267 are formed on an outer periphery of the seal member 260, and O-rings 278 are held in the O-ring holding grooves 265, 266, and 267, respectively. The O-ring holding grooves 265, 266, and 267 are arranged in a lower part of FIG. 7. In a state where the seal member 260 is assembled to the receiver 200, the O-rings 278 are located on a near side (lower side) of the receiver 200.

Figure 9:
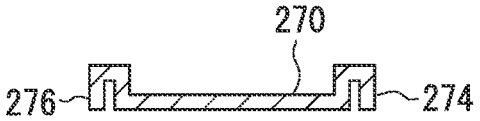
FIG. 9 is a cross-sectional view on a line IX-IX in FIG. 10.
Figure 10:
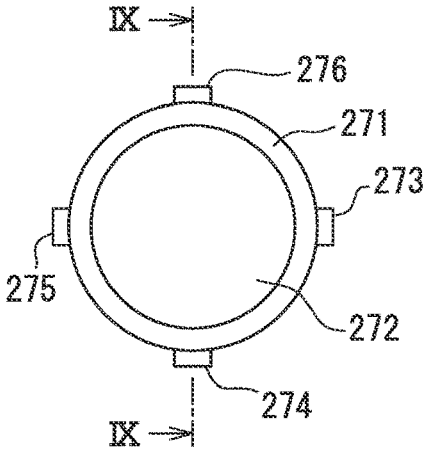
FIG. 10 is a top view of a lid member in FIG. 9.
Figure 17:
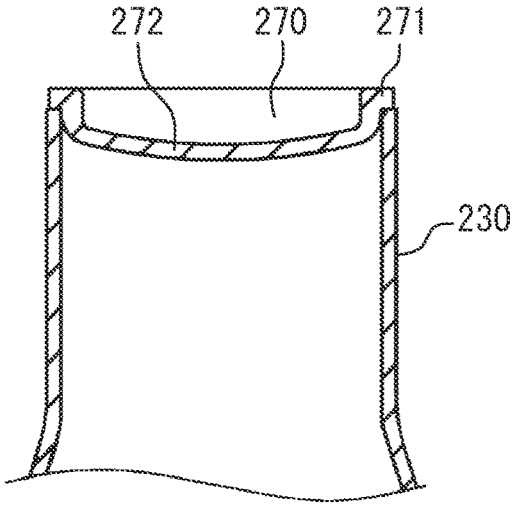
FIG. 17 is a cross-sectional view showing mounting state of a lid member.

FIG. 9 and FIG. 10 show a lid member 270 arranged on the lid side small diameter portion 230. The lid member 270 includes an annular portion 271 that comes into contact with an end portion of the receiver 200, and a cap portion 272 that projects toward an inside of the receiver 200. In addition, four claw portions 273, 274, 275, and 276 are formed on an outer circumference of the annular portion 271. The lid member 270 is caulked and fixed to an end surface of the lid side small diameter portion 230 by the claw portions 273, 274, 275, and 276. FIG. 17 shows a state in which the lid member 270 is attached to the lid side small diameter portion 230 of the receiver 200.

Next, a joining between the receiver 200 and the condenser 100 is described. As shown in FIG. 3, an inflow aperture 202 which allows a refrigerant flow from the condenser 100 opens in the main body portion 220 of the receiver 200. Then, an outflow aperture 203 which allows a refrigerant flow from the receiver 200 to the condenser 100 opens in the intermediate member side small diameter portion 240.

Figure 11:
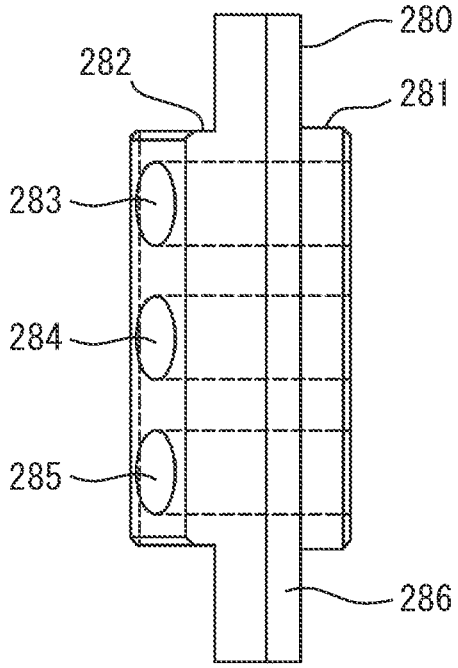
FIG. 11 is a front view of a condenser connector.
Figure 15:
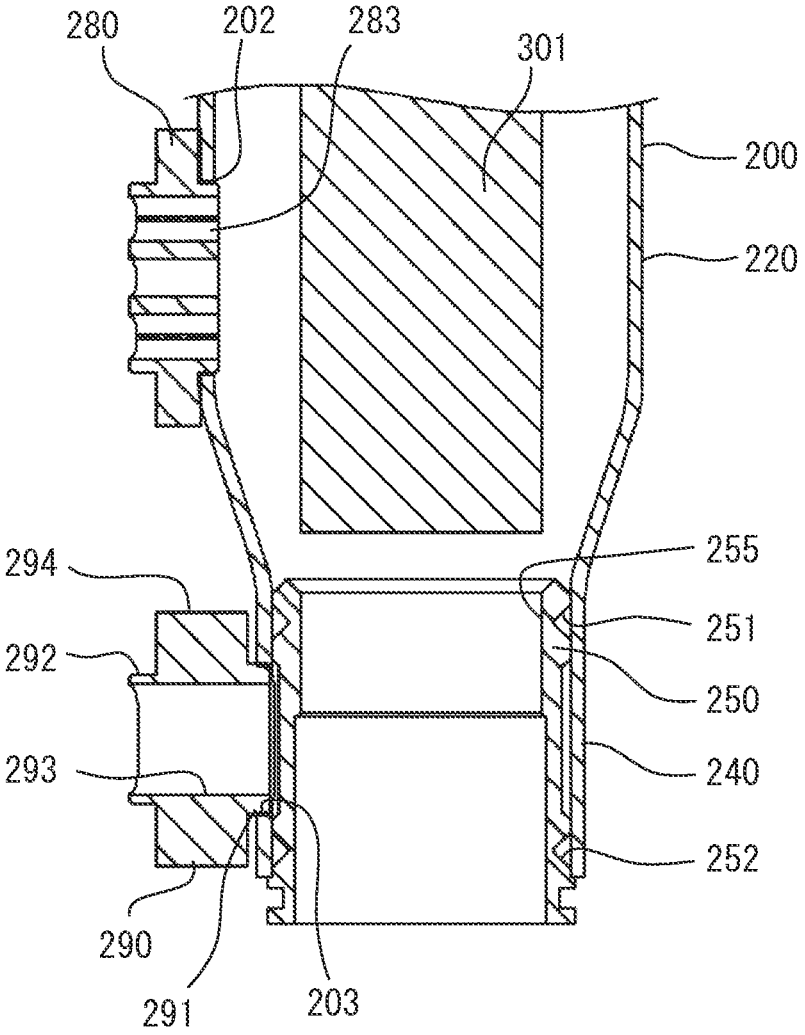
FIG. 15 is a cross-sectional view showing mounting state of the intermediate member.

FIG. 11 shows a condenser connector 280 which connects the inflow aperture 202 of the receiver 200 and the condenser opening aperture 105 (shown in FIG. 15 and FIG. 16) of the left tank 102 of the condenser 100. The condenser connector 280 has a receiver-side convex portion 281 which fits into the inflow aperture 202 and a condenser-side convex portion 282 which fits into the condenser opening aperture 105.

Both the inflow aperture 202 and the condenser opening aperture 105 have an elongated aperture shape and a major axis of about 20 mm. Therefore, by forming three elliptical apertures 283, 284, and 285 inside, the condenser connector 280 enhances the pressure resistant property of a refrigerant passage. That is, it is possible to suppress deformation under an internal pressure load by inner walls between the elliptical aperture 283 and the elliptical aperture 284, and between the elliptical aperture 284 and the elliptical aperture 285, and to improve a pressure resistance property. The left tank 102 and the receiver 200 are communicated with each other by the three elliptical apertures 283, 284, and 285.

Figure 12:
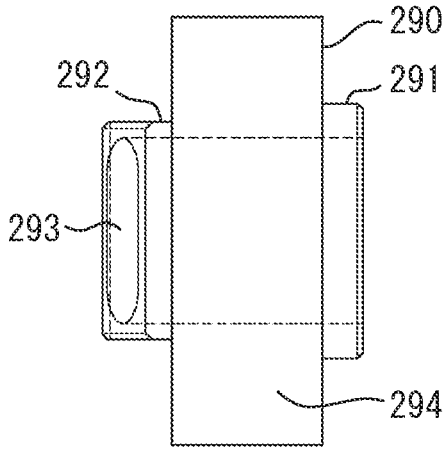
FIG. 12 is a front view of a sub-cooler connector.

FIG. 12 shows a sub-cooler connector 290 which connects the outflow aperture 203 of the receiver 200 and a sub-cooler opening aperture 106 (shown in FIG. 15 and FIG. 16) of the left tank 102 of the condenser 100. Similar to the condenser connector 280, the sub-cooler connector 290 also has a receiver-side convex portion 291 which fits into the outflow aperture 203 and a condenser-side convex portion 292 which fits into the sub-cooler opening aperture 106.

However, since the inflow aperture 203 and the sub-cooler opening aperture 106 are both smaller than the inflow aperture 202 and the condenser opening aperture 105, they are a single elongated aperture 293 having a major axis of about 10 mm. The refrigerant flowing through the condenser connector 280 is substantially the liquid refrigerant, and all the refrigerants flowing through the sub-cooler connector 290 is the liquid refrigerant. Therefore, the total cross-sectional area of the elliptical apertures 283, 284, and 285 of the condenser connector 280 and the cross-sectional area of the elongated hole 293 of the sub-cooler connector 290 are substantially the same.

Further, from the comparison between FIG. 11 and FIG. 12, a width of the central portion 294 of the sub-cooler connector 290 is wider than that of the central portion 286 of the condenser connector 280. This is because the condenser connector 280 comes into contact with the main body portion 220 of the receiver 200, while the sub-cooler connector 290 comes into contact with the intermediate member side small diameter portion 240 of the receiver 200.

That is, as shown in FIG. 16, since a distance between the outflow aperture 203 and the sub-cooler opening aperture 106 is longer than a distance between the inflow aperture 202 and the condenser opening aperture 105, a difference of the distances is filled.

As shown in FIG. 16, an inside of the receiver 200 and the outflow aperture 203 communicate with each other via the seal member 260 and the intermediate member 250. The refrigerant flows from the male screw communication aperture 263 of the seal member 260 to the outflow aperture 202 from the female screw communication aperture 254 through the communication space 253 of the intermediate member 250.

Figure 13:
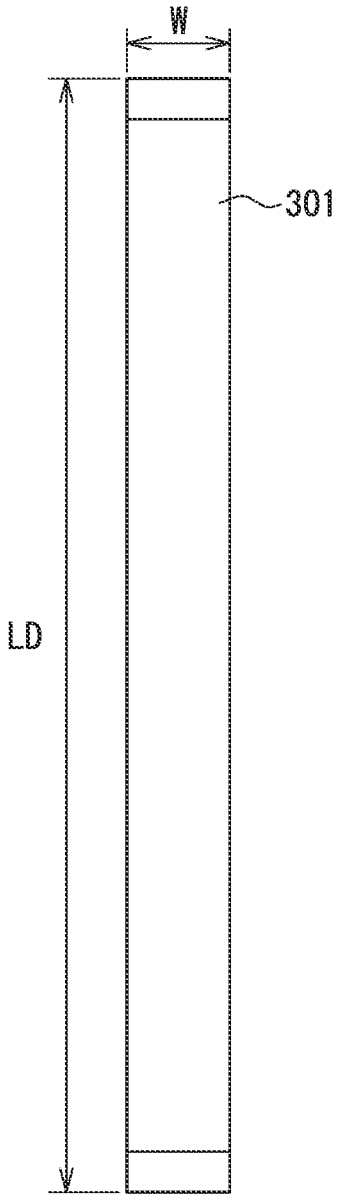
FIG. 13 is a front view of a dryer.
Figure 14:
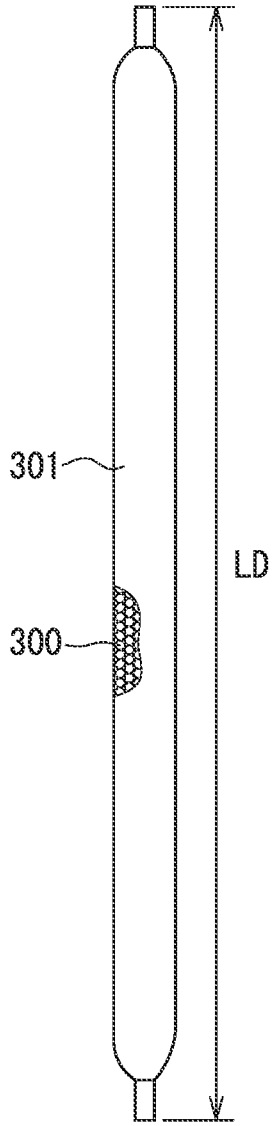
FIG. 14 is a left side view of FIG. 13.

Next, the desiccant loaded inside the receiver 200 is described. The desiccant 300 is made of granular zeolite and is enclosed in a bag 301 as shown in FIG. 13 and FIG. 14. The bag 301 is made of a resin non-woven fabric such as polyethylene terephthalate (PET) and has flexibility. A length of the bag 301 is about 345 mm so that it can be loaded inside the receiver 200. The bag 301 is formed by folding the resin non-woven fabric and heat-welding periphery thereof. In a state where the bag 301 is formed to seal the desiccant 300, a width W of the bag 301 is about 35 mm and a thickness is about 15 mm.

A water absorption amount may be calculated by multiplying a water absorption rate to an amount of desiccant. Since a weight of the desiccant 300 enclosed in the bag 301 is about 75 grams, it is possible to adsorb about 16 grams of water per one bag 301. Then, in this example, three bags 301 of the desiccant 300 can be loaded in the receiver 200.

Next, a method of manufacturing the condenser 100 in which the receiver 200 is integrated is described. The receiver 200 is manufactured by machining a raw material which is made of aluminum or aluminum alloy and has a circular cylindrical shape by a spinning process. Both ends of the raw material having a circular cylindrical shape are machined by the spinning process. By reducing the diameters on both the upper and lower sides of a raw material having the circular cylindrical shape, the lid portion side small diameter portion 230 and the intermediate member side small diameter portion 240 are formed. An inclined portion 231 continuous with the main body portion 220 and the lid portion side small diameter portion 230 is formed by spinning. Similarly, between the main body portion 220 and the intermediate member side small diameter portion 240, an inclined portion 241 continuous with them is formed by spinning.

The lid member 270 is caulked and fixed to the lid side small diameter portion 230 of the receiver 200. The lid member 270 is a clad material having a brazing material coated on its surface, and the receiver 200 is an aluminum or aluminum alloy bare material having a brazing material coated on its surface. Further, brazing materials are arranged in the annular grooves 251 and 252 of the intermediate member 250, and in that state, the intermediate member 250 is press-fitted into the intermediate member side small diameter portion 240.

The condenser 100 stacks the upper reinforcing plate 120, the fins 111, the tubes 110, and the lower reinforcing plate 121, and in that state, fits the tanks 101 and 102 on both left and right sides. For the upper reinforcing plate 120, the tubes 110, and the lower reinforcing plate 121, a bare material of aluminum or an aluminum alloy having a brazing material coated on surfaces is used. Further, the fins 111 use a clad material having a brazing material coated on surfaces.

Next, the inflow aperture 202 of the receiver 200 and the condenser opening aperture 105 of the left tank 102 are connected by the condenser connector 280. Further, the outflow aperture 203 of the receiver 200 and the sub-cooler opening aperture 106 of the left tank 102 are connected by the sub-cooler connector 290. Then, the holding plate 210 is inserted into the left tank 102, and the holding plate 210 holds the main body portion of the receiver 200.

FIGS. 18 to 20 show cross-sectional shapes in this state. As shown in FIG. 20, a holding aperture 108 is formed in the left tank 102, and the engaging convex portion 211 of the holding plate 210 is fitted into the holding aperture 108. The holding plate 210 is also a bare material of aluminum or an aluminum alloy having a brazing material coated on surfaces.

In this way, the condenser 100 and the receiver 200 are carried into a furnace in a state of being temporarily assembled mechanically. A temperature inside the furnace is about 580 to 610 degrees Celsius. The fins 111 and tubes 110 having large heat receiving area are heated fast, and heat is transferred to the tanks 101 and 102. Next, heat is transferred to the receiver 200 via the condenser connector 280 and the sub-cooler connector 290.

Here, brazing is particularly important for the intermediate member 250. Since the intermediate member 250 has a large heat capacity, it is difficult to raise the temperature. In addition, since the intermediate member 250 is arranged at a tip end of the receiver 200, it is arranged at an end of a heat transfer path, and it is more difficult to raise a temperature. If a temperature rise is difficult, brazing may be difficult. In addition, it takes time to raise a temperature, which may reduce a production rate and reduce a productivity.

If the intermediate member side small diameter portion 240 is not formed on a lower portion of the receiver 200 and is the same as the diameter (D1) of the main body portion 220, the diameter of the intermediate member 250 must also be increased. As a result, a heat capacity of the intermediate member 250 also have to be increased.

On the other hand, in this example, an inner diameter ratio (D1/D3) of the intermediate member side small diameter portion 240 is reduced to 76%. Therefore, as described above, the thickness of the intermediate member 250 can be significantly reduced as compared with the case where the intermediate member side small diameter portion 240 is not formed. Due to the decrease in thickness, the heat capacity of the intermediate member 250 is further reduced, making it easier to raise the temperature.

This heat capacity problem is also improved in the lower portion of the receiver 200. Assuming that the intermediate member side small diameter portion 240 is not formed on the lower portion of the receiver 200, a plate thickness of the receiver 200 at a portion where the intermediate member 250 is arranged is similar to a plate thickness (t1) of the main body portion 220 even. In that case, the heat capacity in the lower portion of the receiver 200 becomes large. The temperature may not be sufficiently raised due to this large heat capacity in the lower portion of the receiver 200.

However, in the present disclosure, the inner diameter ratio (D1/D3) of this portion is reduced to 76% as the intermediate member side small diameter portion 240. Not only the diameter is reduced, but also the plate thickness (t3) is reduced in the intermediate member side small diameter portion 240. The plate thickness ratio (t1/t3) with the main body portion 220 is reduced to 68%. That is, the plate thickness ratio is made smaller than the reduced diameter, and the heat capacity of the lower portion of the receiver 200 is made smaller. Therefore, the temperature can be raised sufficiently and brazing can be performed reliably.

The holding plate 210 at least holds the receiver 200 at a predetermined strength regardless of a leak of the receiver 200 or a leak of the condenser 100. Since a temperature of the left tank 102 is sufficiently high, it is possible to braze the holding aperture 108 appropriately.

Then, after the brazing is completed, the bag 301 of the desiccant 300 is loaded into the receiver 200, and finally the male screw 264 of the seal member 260 and the female screw 255 of the intermediate member 250 are screwed together. Thereby, a manufacturing of the condenser 100 in which the receiver 200 is integrated is completed.

Next, a loading and unloading process of the desiccant is described. As described above, at the time of assembling, after the brazing is completed, the bag 301 is inserted into the main body portion 220 of the receiver 200 through the central portion 256 of the intermediate member 250 having the circular cylindrical shape. As shown in FIG. 2, the receiver 200 has a total length LL in the axial direction. As shown in FIG. 4, the main body portion 220 has an effective length LR for accommodating a plurality of bags 301 in the axial direction. The effective length LR is a distance including an entire lid side small diameter portion 230 and an entire tapered shape 241. The effective length LR is set in consideration of a deformation of three bags 301.

Figure 25:
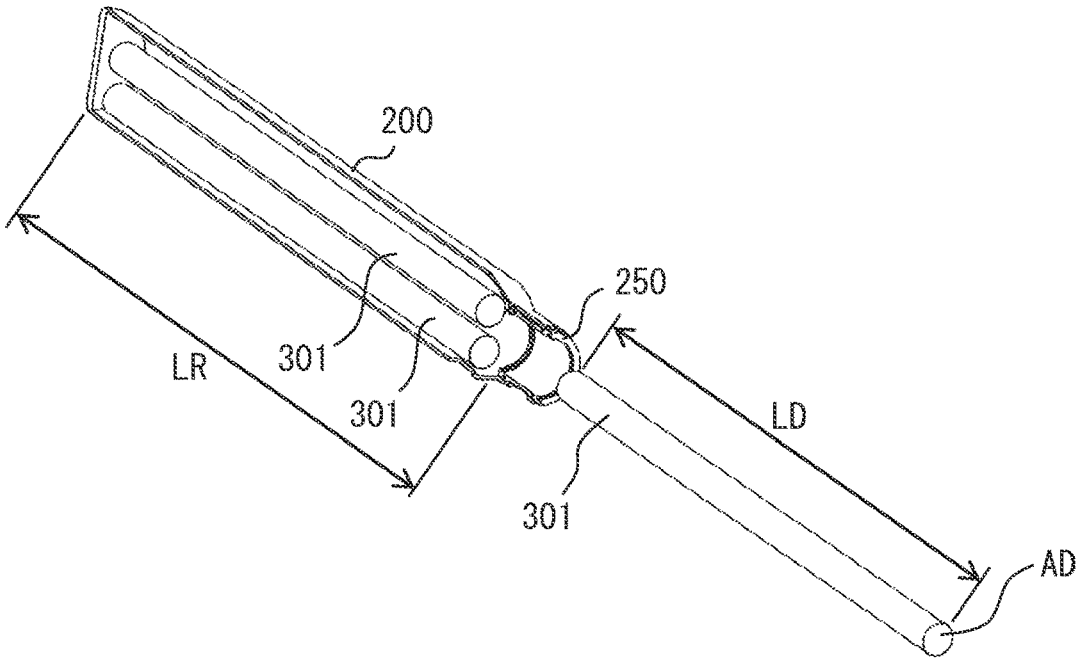
FIG. 25 is a partial cross-sectional perspective view showing another example of a dryer.

Since there are three bags 301, after inserting a first bag 301, the bag 301 is laterally displaced and a second bag 301 is inserted. In the state where the second bag 301 is inserted, the two bags 301 are further shifted, and a third bag 301 is inserted into a gap. FIG. 25 shows a state in which the third bag 301 is inserted after inserting two bags 301.

Here, an inner diameter of the central portion 256 of the intermediate member 250 is about 25 mm, and a width W of the bag 301 is 35 mm. However, since the bag 301 is flexible and has a thickness of 15 mm, it is possible to load the desiccant 300 into the main body portion 220 of the receiver 200 while deforming the bag 301.

As described above, the desiccant 300 of the present disclosure can adsorb about 16 grams of moisture with one bag 301. This is a sufficient amount of one bag 301 for a normal usage of an automobile air conditioner.

However, the air conditioners for agricultural machinery and construction machinery, in which the condenser 100 with the integrated receiver 200 of the present disclosure is used, are more often uses rubber hoses and O-rings than air conditioners for automobiles. Since an amount of moisture mixed into the refrigerant is more than that of automobile air conditioners, therefore a larger amount of desiccant 300 is used. In the present disclosure, since three bags 301 are prepared, three times as much moisture can be adsorbed.

In the present disclosure, the desiccant 300 can be replaced after a predetermined period of use. This replacement is usually done at the same time as a filling work of the refrigerant and a maintenance work of other equipment in the refrigeration cycle. At the time of replacement, the seal member 260 is removed from the intermediate member 250 by rotating the seal member 260.

In that state, the bag 301 is pulled out from the central portion 256 of the intermediate member 250 by using a special tool like a shape of tweezers. Here, since the desiccant 300 does not expand even if it adsorbs moisture, the bag 301 can be pulled out in the same manner as the insertion operation.

As shown in FIG. 20, the desiccant 300 includes a plurality of bags 301. The desiccant 300, which can be called powdery or granular, is enclosed in the bag 301. The desiccant 300 may include one bag 301 or two or more bags 301. In this embodiment, the number of bags 301 is "n", and 1<n. That is, three bags 301 are used. As shown in FIG. 20, the plurality of bags 301 are arranged so that cross sections of all the bags 301 appear in a cross section perpendicular to the axial direction of the main body portion 220. In other words, the plurality of bags 301 are arranged in parallel with respect to the axial direction inside the main body portion 220. One bag 301 has a predetermined cross-sectional shape and its cross-sectional area AD. The cross-sectional shape is a shape which can pass through both the female screw 255 and the central portion 256. The cross-sectional area AD is a cross-sectional area where the bag 301 can pass through both the female screw 255 and the central portion 256.

In a manufacturing method or a replacement method, the bag 301 can be deformed in cross-sectional shape. The cross-sectional shape of the bag 301 is deformable between a circular shape and an eyelid-like shape. One bag 301 is deformable into a shape that allows it to pass through both the female screw 255 and the central portion 256. The shape of the cross section of one bag 301 in a natural state is smaller than both the female screw 255 and the central portion 256, and is a shape that can pass through both the female screw 255 and the central portion 256. The cross-sectional area AD may be the minimum value when the bag 301 passes through both the female screw 255 and the central portion 256. The bag 301 is set to have a cross-sectional area AD smaller than the cross-sectional area of the main body portion 220 in order to pass through both the female screw 255 and the central portion 256. The cross-sectional area AD of one bag 301 is smaller than the cross-sectional area of both the female screw 255 and the central portion 256, at least in the minimum value. In this embodiment, the maximum value of the cross-sectional area AD that the bag 301 can take is also smaller than the cross-sectional area of both the female screw 255 and the central portion 256. The cross-sectional area AD is also referred to as the required cross-sectional area required for the bag 301 to pass through both the female thread 255 and the central portion 256.

In this embodiment, the bag 301 has a length LD even when the cross-sectional area AD of the bag 301 has a minimum value. In other words, the bag 301 has a length LD even when the bag 301 passes through both the female screw 255 and the central portion 256. The length LD of the bag 301 as the bag 301 passes through both the female screw 255 and the central portion 256 can also be referred to as a process length in the manufacturing method or the replacement method.

As illustrated in FIG. 13 or FIG. 14, the bag 301 has a length LD in the axial direction. The axial direction is the direction in which the bag 301 is taken in and out through both the female screw 255 and the central portion 256 of the intermediate member 250. The length LD of one bag 301 is shorter than the effective length LR of the main body portion 220 (LD<LR). The total length (2×LD) of the two bags 301 is longer than the effective length LR (2×LD>LR). The total length (2×LD) of the two bags 301 is longer than the total length LL (2×LD>LL). In this embodiment, the total length (3×LD) of the three bags 301 is longer than the effective length LR (3×LD>LR). In other words, the total process length (3×LD) of three bags 301 is longer than the effective length LR (3×LD>LR). The total length (3×LD) of three bags 301 is longer than the total length LL (3×LD>LL). In other words, the total process length (3×LD) of three bags 301 is longer than the total length LL (3×LD>LL).

Three bags 301 have a total length (3×LD) even when they are taken out of the receiver 200. A total length (3×LD) of three bags 301 is also referred to as a deployed length. The deployed length is a length in a state where three bags 301 are deployed at an outside of the receiver 200. The deployed length is longer than the effective length LR. The deployed length is longer than the total length LL.

In the present disclosure, the desiccant 300 is separately enclosed in a plurality of flexible bags 301. Since it is divided into a plurality of pieces, each bag 301 can be made smaller. Therefore, even if a portion where the desiccant 300 is taken in and out is made smaller by forming the intermediate member side small diameter portion 240, workability is not impaired.

Second Embodiment

In the above disclosure, the lid portion side small diameter portion 230 is formed on an upper end of the receiver 200, but the diameter D1 of the main body portion 220 may be extended upward without reducing a diameter of an upper portion. This is because the lid member 270 originally has a small heat capacity, so that good brazing can be performed even when the diameter is not reduced. In this example, the diameter of the receiver 200 is reduced only in the lower portion.

Figure 21:
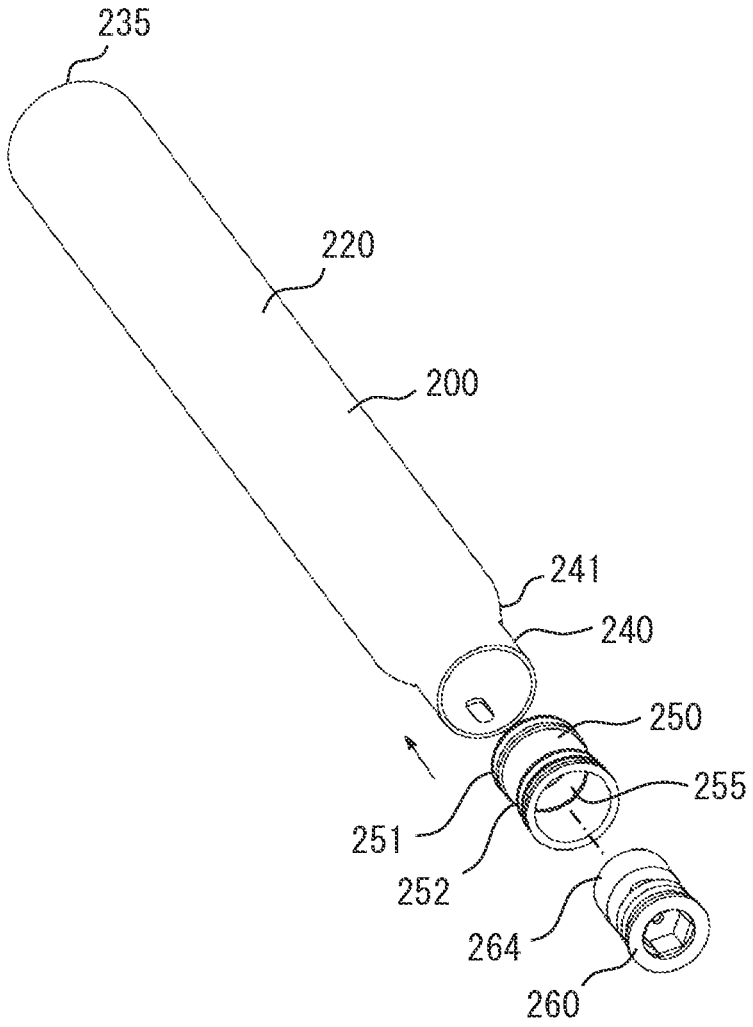
FIG. 21 is a perspective view of a second embodiment of a condenser with an integrated receiver.
Figure 22:
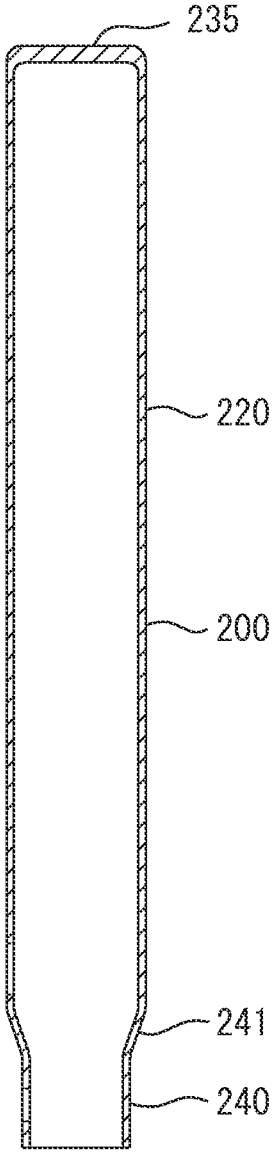
FIG. 22 is a cross-sectional view of FIG. 21.

Further, as shown in FIG. 21 and FIG. 22, the receiver 200 may have a circular cylindrical shape with a closed upper end 235. The upper end 235 replaces the lid member 270, and the lid member 270 can be abolished. In this example, only the lower portion is reduced in diameter in the same manner as in the first embodiment to form the intermediate member side small diameter portion 240.

The feature of the present disclosure is in view of a weight increase due to the seal structure used for taking in and out the desiccant 300, and in particular, the weight increase due to the fixing of the intermediate member 250 of the seal structure. Therefore, the diameter reduction is required only for the intermediate member side small diameter portion 240, and it is not necessary to form the small diameter portion on the lid member 270 and the upper end 235 side.

Third Embodiment

Figure 23:
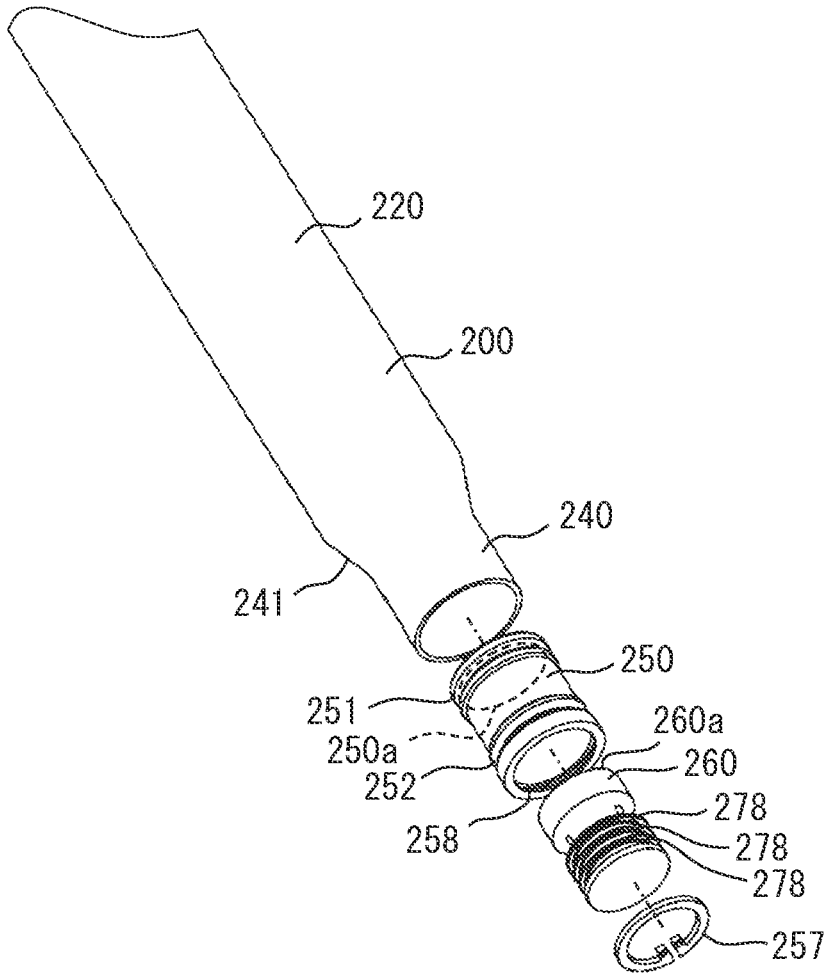
FIG. 23 is a perspective view of a third embodiment of a condenser with an integrated receiver.

In the first embodiment and the second embodiment, the intermediate member 250 and the seal member 260 are screw-coupled with screws, but other coupling methods may be used. As shown in FIG. 23, a C-ring 257 may be used for fixing.

In the third embodiment, a groove 258 is formed at a lower end of the intermediate member 250 so that the C-ring 257 can be mounted on the groove 258. Then, on an inner circumference of an upper end portion of the intermediate member 250, a shoulder portion 250*a* to which the upper end portion 260*a* of the seal member 260 abuts is formed.

For assembly, the seal member 260 is inserted into an inner circumference of the intermediate member 250 so that the upper end portion 260*a* of the seal member 260 abuts on the shoulder portion 250*a* of the intermediate member 250, and in that state, the C-ring 257 is placed in the groove 258. As a result, the seal member 260 is prevented from coming off.

Also in this third embodiment, the intermediate member 250 is formed with a communication aperture which communicates with the communication aperture 263 of the seal member 260. The refrigerant inside the receiver 200 flows from the outflow aperture 203 to the condenser 100 through the communication apertures of the seal member 260 and the intermediate member 250.

Fourth Embodiment

Figure 24:
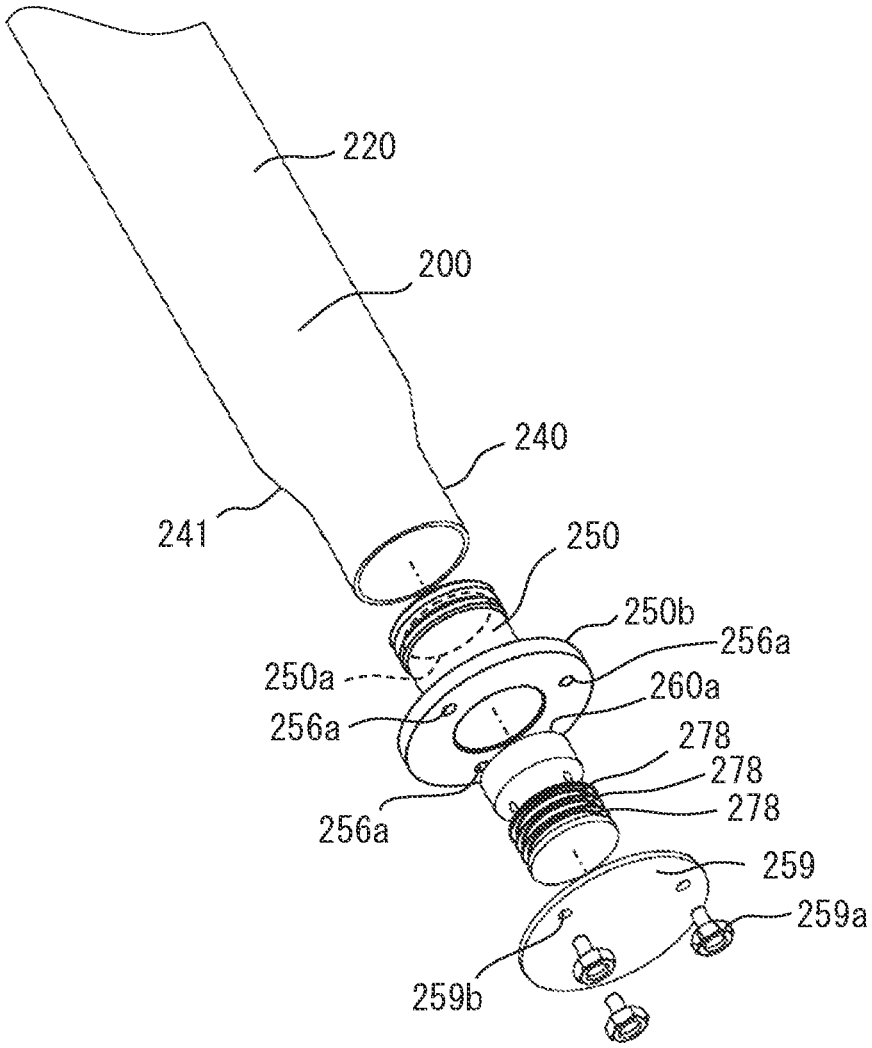
FIG. 24 is a perspective view of a fourth embodiment of a condenser with an integrated receiver.

Further, instead of providing screws on the intermediate member 250 and the seal member 260, bolts may be used for fixing. As in the fourth embodiment shown in FIG. 24, a flange 250*b* is formed at a lower end of the intermediate member 250, and screw apertures 256*a* are formed in the flange 250*b*. Further, a support plate 259 facing the flange 250*b* is arranged, and through apertures 259*b* are formed in the support plate 259 at positions corresponding to the screw apertures 246*a*. A shoulder portion 250*a* is formed at an upper end portion of the intermediate member 250 as in the third embodiment.

For assembly, the seal member 260 is inserted into the inner circumference of the intermediate member 250 so that the upper end portion 260*a* of the seal member 260 comes into contact with the shoulder portion 250*a* of the intermediate member 250. In that state, the lower end of the seal member 260 is supported by the support plate 259, and the bolts 259*a* is screwed into the screw apertures 256*a* from the through apertures 256*b*.

It is the same as in the third embodiment to flow the refrigerant inside the receiver 200 from the outflow aperture 203 to the condenser 100 through the communication apertures of the seal member 260 and the intermediate member 250.

Other Embodiments

The above is a desirable example of the present disclosure, but the present disclosure can be variously modified within the scope of this disclosure.

Gaps between the main body portion 220 of the receiver 200 and the lid side small diameter portion 230, and between the main body portion 220 and the intermediate member side small diameter portion 240 are not limited to the tapered shape, but may use other shapes such as bell mouth shapes, arc shapes, etc. It may use shapes which can avoid a corner portion where stress is concentrated.

In the above disclosure, two partition plates 104 are arranged in each of the right tank 101 and the left tank 102 so that the refrigerant flow reciprocates twice in the condenser 100, but other flow patterns may be used. That is, by appropriately arranging the partition plate 104, the refrigerant flow may be a U-turn, an S-turn, or even more turns.

Further, in the above example, the intermediate member 250 and the seal member 260 are arranged at the lower portion of the receiver 200, but they may be arranged on an upper portion. In that case, if the refrigerant flow does not turn at a portion of the intermediate member 250, the female screw communication aperture 254 and the male screw communication aperture 263 may become unnecessary. In addition, in the third embodiment and the fourth embodiment, the female screw 255 and the male screw 264 are not provided. Therefore, the third embodiment and the fourth embodiment include elements called the intermediate member communication aperture 254 and the seal member communication aperture 263 instead of the names of the female screw communication aperture 254 and the male screw communication aperture 263.

In the above disclosure, the sub-cooler portion through which the liquid refrigerant from the receiver 200 flows is formed below the condenser 100, but this may be formed above. That is, in the above disclosure, the inlet side connector 140 is arranged on the upper portion of the condenser 100 and the outlet side connector 141 is arranged on the lower portion of the condenser 100, but the inlet side connector 140 may be arranged on the lower portion and the outlet side connector 141 may be arranged on the lower portion.

The receiver 200 of the above disclosure has a main body portion 220 having a diameter of 45 mm. In the present disclosure, the main body portion 220 intentionally has a large diameter. As the main body portion having a large diameter, outer diameter may be about 40 to 55 mm. A wall thickness of more than 1.9 mm is also used for a large diameter main body portion, and an example of 2 to 2.5 mm may also be common.

In the above disclosure, since the seal member 260 is made of resin, it is easy to form the filter 262 and it is possible to reduce weight. However, it is possible to form the seal member 260 with aluminum or an aluminum alloy.

It is not necessary to dispose the filter 262 integrally with the seal member 260, and the filter 262 may be arranged at another position.

In the above disclosure, two annular grooves 251 and 252 for holding the brazing materials are formed in the intermediate member 250, but if necessary, only the annular groove 252 in front of the female screw communication aperture 254 may be formed. A performance of the receiver 200 as a pressure-resistant container can be ensured by surely brazing even at least one portion. Moreover, even by brazing at one place, it is possible to compensate for the lack of strength due to a thinning of the intermediate member side small diameter portion 240.

Further, in the above disclosure, since three O-ring holding grooves 265, 266, and 267 are formed on the seal member 260, it is possible to ensure a seal of the seal member 260 by three O-rings 278. Alternatively, two or one of the O-ring holding groove may be formed. If a sealing performance can be ensured, it is not necessarily limited to three.

In the above disclosure, the bag 301 of the desiccant 300 is formed by heat welding polyethylene terephthalate (PET), but other materials may be used. Further, sewing may be performed instead of heat welding.

In the above disclosure, the receiver 200 is held in the left tank 102 by the holding plate 210, but may be held in the right tank 101. In that case, the inlet side connector 140 and the outlet side connector 141 are arranged in the left tank 102. This makes it possible to increase the degree of freedom in handling the refrigerant piping.

In the above disclosure, Freon R134A was used as the refrigerant, but other refrigerants such as Freon R1234yf may be used. Since the pressure resistant strength of the receiver differs depending on each refrigerant, the wall thickness must also be adjusted. In the above disclosure, the number of bags 301 for enclosing the desiccant 300 is three, but it may be two or more. Further, a shape of the bag 301 may also be a columnar shape as shown in FIG. 25. In this embodiment, the plurality of bags 301 are arranged in parallel with each other with respect to the axial direction inside the main body portion 220.

The bag 301 is flexible. The number of bags 301 is "n", and 1<n. The bag 301 has a circular cross-sectional shape in a natural state where it is not subjected to an external force. The bag 301 can be slightly deformed from a circular shape. Also in this embodiment, the cross-sectional area AD of one bag 301 is smaller than the cross-sectional area of the central portion 256. The shape of the cross section of one bag 301 in the natural state is smaller than that of the central portion 256 and can pass through the central portion 256. The total length (3×LD) of the plurality of bags 301 can be referred to as the deployed length. Also in this embodiment, the relationship of the lengths (LD, LR, LL, deployed length) of the plurality of members defined in the above-described embodiment is satisfied.

Figure 26:
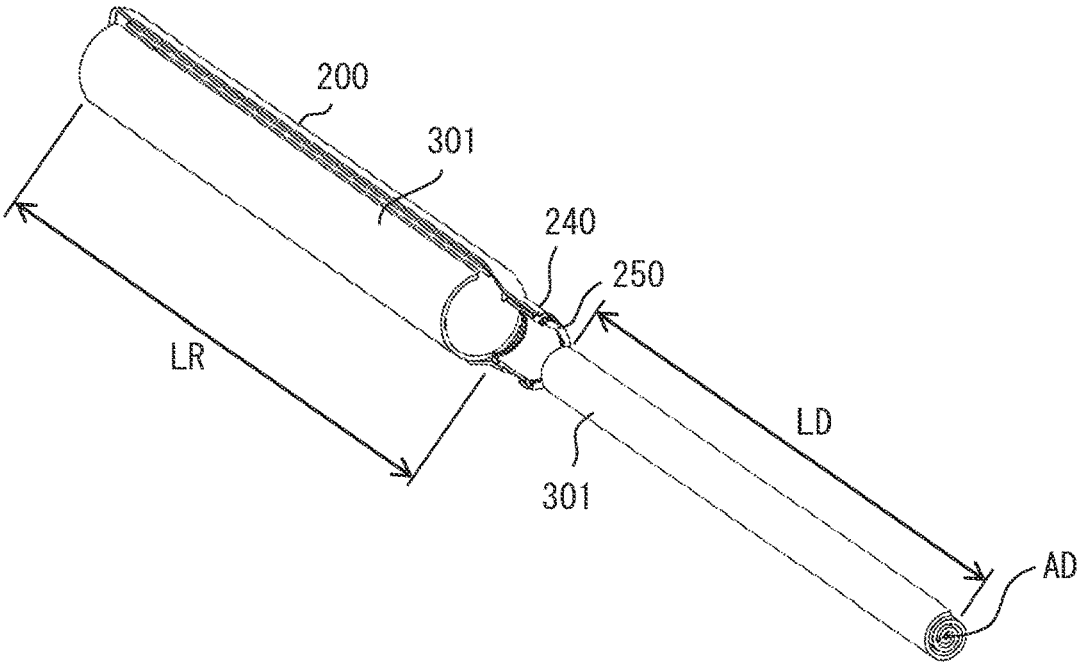
FIG. 26 is a partial cross-sectional perspective view showing still another example of a dryer.

The bag 301 of the desiccant 300 may be in a sheet shape as shown in FIG. 26. The sheet shaped bag 301 is rolled up and is inserted into the receiver 200 from the intermediate member side small diameter portion 240. After insertion, the bag 301 expands with its own restoring force. FIG. 26 shows a state in which a previously inserted bag 301 is expanded and a second sheet shaped bag 301 is inserted into the space inside the bag 301. In this embodiment, the plurality of bags 301 are arranged in parallel with each other with respect to the axial direction inside the main body portion 220.

Also in this embodiment, the bag 301 has flexibility. The number of bags 301 is "n", and 1<n. The cross-sectional area AD of one bag 301 is smaller than the cross-sectional area of the central portion 256. One bag 301 can be deformed into a shape that allows it to pass through the central portion 256. In this embodiment, the bag 301 is rolled into a shape smaller than the circular cross section of the central portion 256. The cross-sectional area AD is a required cross-sectional area for inserting the sheet shaped bag 301 into the central portion 256. Also in this embodiment, the relationship of the lengths (LD, LR, LL, deployed length) of the plurality of members defined in the above-described embodiment is satisfied.

In this embodiment, a length in a rolling direction of the bag 301, that is, a length in the circumferential direction of the bag 301 may be defined as the length LD of one bag 301. Also in this case, the relationship of the lengths (LD, LR, LL, deployed length) of the plurality of members defined in the above-described embodiment is satisfied.

Figure 27:
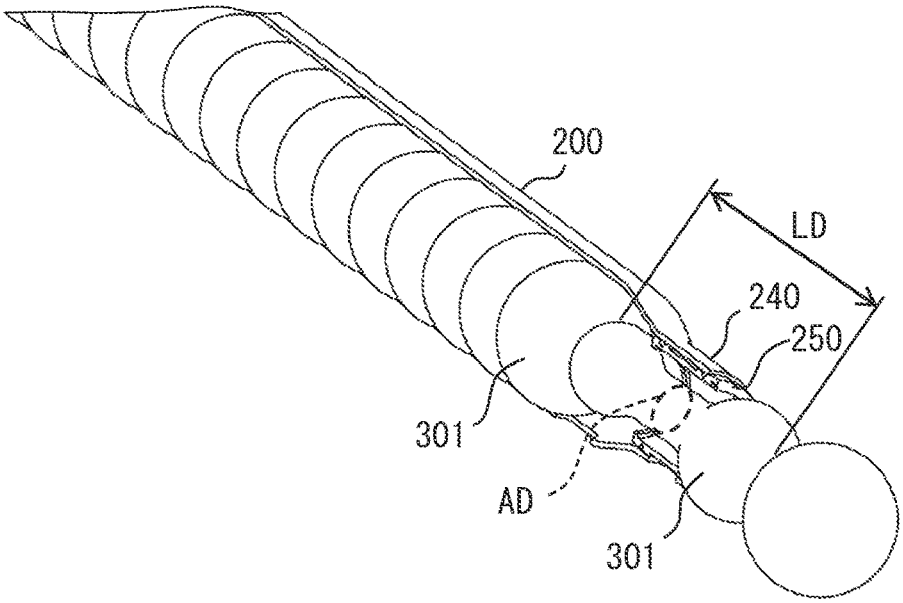
FIG. 27 is a partial cross-sectional perspective view showing still another example of a dryer.

As shown in FIG. 27, a deformable flexible bag 301 may be used. The bag 301 is a sphere in a natural state where no external force is applied. In the manufacturing method or the replacement method, the bag 301 is deformed in an elongated shape in a state of passing through the intermediate member side small diameter portion 240. At this time, the cross-sectional area AD of a constricted portion of the bag 301 is the required cross-sectional area for inserting the bag 301 into the central portion 256. At this time, the bag 301 has the process length LD. In this embodiment, a plurality of bags 301 are inserted into the main body portion 220. The number of bags 301 is "n", and 1<n. When inserted into the main body portion 220, the bags 301 are deformed into a flat elliptical sphere by pressing the plurality of bags 301 against each other. As a result, an outer surface of the bag 301 may be brought into contact with an inside of the main body portion 220. In this embodiment, the plurality of bags 301 are arranged in series with each other with respect to the axial direction inside the main body portion 220.

Also in this embodiment, the cross-sectional area AD of one bag 301 is smaller than the cross-sectional area of the central portion 256. In this embodiment, the total process length LD (n×LD) of "n" bags 301 is longer than the effective length LR or the total length LL (n×LD>LR, or n×LD>LL). Further, the "n" bags 301 can be deformed to a total length (n×LD) when taken out of the receiver 200. A total length (n×LD) of "n" bags 301 can also be referred to as the deployed length. The deployed length is a length in a state where "n" bags 301 are deployed at an outside of the receiver 200. Also in this embodiment, the relationship of the lengths (LD, LR, LL, deployed length) of the plurality of members defined in the above-described embodiment is satisfied.

Figure 28:
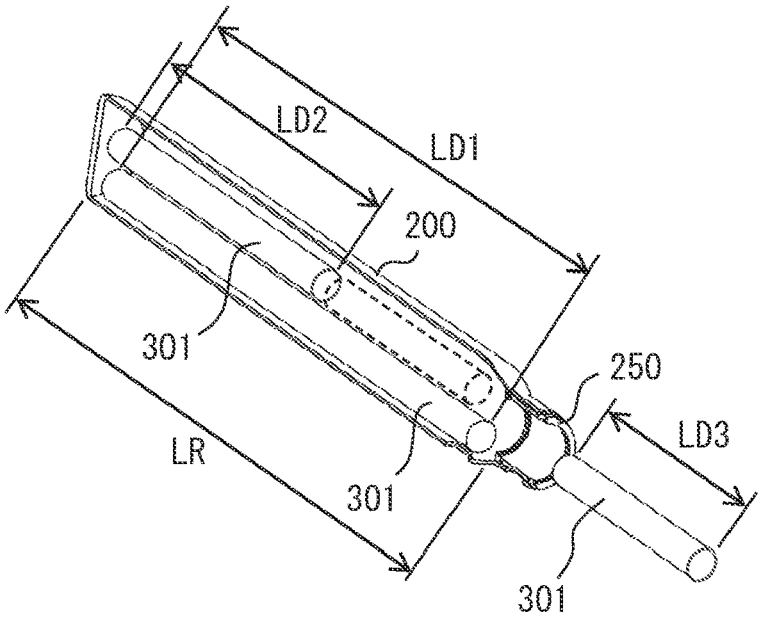
FIG. 28 is a partial cross-sectional perspective view showing still another example of a dryer.

In the above disclosure, the plurality of bags 301 have equal length LDs. Alternatively, the plurality of bags 301 may have several different lengths, such as LD1, LD2, LD3, etc., as shown in FIG. 28. Also in this case, a total length ΣDn=LD1+LD2+LD3 satisfies the above-mentioned relationship instead of the total length n×LD. In the above disclosure, the condenser 100 in which the receiver 200 is integrated is used for the air conditioner of agricultural machinery and construction machinery. The air conditioners for agricultural machinery and construction machinery are highly permeable to moisture and are therefore suitable for use in this disclosure. However, depending on usage environments, even an automobile air conditioner may have a large amount of moisture permeation. Therefore, it is possible to use the condenser 100 integrated with the receiver 200 of the present disclosure for an automobile air conditioner.

JP2012-112639A, JP2002-350001A and JP2002-372342A disclose condensers. The condenser includes an integral receiver. Since it is common as road vehicles, air conditioners for agricultural machinery and construction machinery usually use automobile air conditioners. In the automobile air conditioners, in order to absorb engine vibration, the refrigerant flow toward a compressor and the refrigerant flow discharged from the compressor to the condenser are piped by rubber hoses. Metal piping is usually used for the piping of the refrigerant flowing from the condenser to the expansion valve and the refrigerant flowing from the evaporator to the vicinity of the compressor.

The air conditioners for agricultural machinery and construction machinery are used under state of greater vibrations. Therefore, the rubber hoses are often used for the refrigerant piping that flows from the condenser to the expansion valve too. Moreover, even when a metal pipe is used, a relatively short metal pipe is often connected by using a connector.

Here, in an O-ring used for the rubber hose and the connector of the refrigerant pipe, the moisture in the air is unavoidably mixed with the refrigerant. Therefore, an amount of moisture mixed in the refrigerant is larger in the air conditioners for agricultural machinery and construction machinery than in the air conditioners for the automobiles.

In view of the above points, the present disclosure intends to disclose a condenser with an integrated receiver which loaded with a large amount of desiccant. The resent disclosure is suitable for use in an air conditioner of an agricultural machine or a construction machine using a large amount of desiccant. The condenser with an integrated receiver in the present disclosure is suitable for use in an air conditioner for agricultural machinery and construction machinery.

What is claimed is:

1. A condenser with an integrated receiver, comprising:

a pair of tanks into which a refrigerant flows in and out;

a plurality of tubes arranged between the pair of tanks;

fins which promote heat exchange between the refrigerant flowing in the tubes and air; and a receiver which is connected to one of the tanks, allows an inflow of a refrigerant from the tank, stores a liquid refrigerant therein, and allows outflow of the liquid refrigerant, wherein the receiver includes:

a main body portion having a circular cylindrical shape;

an intermediate member side small diameter portion formed on one side of the main body portion;

an intermediate member arranged in the intermediate member side small diameter portion;

a seal member which engages with the intermediate member and closes the intermediate member side small diameter portion of the receiver; and a desiccant enclosed in a flexible bag, wherein the desiccant is capable of being taken in and out of the main body portion of the receiver in a state that the seal member is removed from the intermediate member, and wherein the receiver has a wall thickness at the intermediate member side small diameter portion which is smaller than a wall thickness of the main body portion, and wherein the pair of tanks, the tubes, the fins, the main body portion of the receiver, the intermediate member side small diameter portion, and the intermediate member are made of aluminum or an aluminum alloy and are integrally brazed to each other.

2. The condenser with an integrated receiver, according to claim 1, wherein a ratio of an inner diameter of the intermediate member side small diameter portion of the receiver to an inner diameter of the main body portion is smaller than a ratio of a wall thickness of the intermediate member side small diameter portion of the receiver to a wall thickness of the main body portion.

3. The condenser with an integrated receiver, according to claim 1, wherein a ratio of an inner diameter of the main body portion of the receiver to an inner diameter of the intermediate member side small diameter portion is 50% or more and less than 80%.

4. The condenser with an integrated receiver, according to claim 1, wherein an inclined portion is formed between the main body portion of the receiver and the intermediate member side small diameter portion.

5. The condenser with an integrated receiver, according to claim 1, wherein the intermediate member is a circular cylindrical shape which has both open ends and an outer periphery formed with at least one annular groove to hold a brazing material.

6. The condenser with an integrated receiver, according to claim 1, wherein the seal member is a circular cylindrical shape which has one closed end and an outer periphery on the one closed end side formed with at least one O-ring holding groove, and wherein further comprises an O-ring held in the O-ring holding groove.

7. The condenser with an integrated receiver, according to claim 1, wherein the desiccant is enclosed in a flexible bag, and has a length in a deployed state at an outside of the receiver is longer than a length of the receiver.

8. The condenser with an integrated receiver, according to claim 1, wherein the desiccant is enclosed in a plurality of bags, and wherein one bag has a length in a direction of loading and unloading through a central portion of the intermediate member, and wherein a total length of the plurality of bags is longer than a total length of the receiver in an axial direction or an effective length of the main body portion for accommodating the plurality of bags.

9. The condenser with an integrated receiver, according to claim 1, wherein the desiccant is enclosed in a plurality of bags, and wherein the plurality of bags are arranged in parallel and/or in series with respect to an axial direction inside the main body portion.

10. The condenser with an integrated receiver, according to claim 1, wherein the receiver includes:

an inflow aperture which is formed in the main body portion to allow an inflow of the refrigerant from the tank;

an outflow aperture which is formed in the intermediate member side small diameter portion to allow an outflow of the refrigerant to the tank;

an intermediate member communication aperture which is formed in the intermediate member to communicate with the outflow aperture; and a seal member communication aperture which is formed in the seal member to communicate with the intermediate member communication aperture.

* * * * *